US010490930B2

(12) United States Patent
Kifune et al.

(10) Patent No.: US 10,490,930 B2
(45) Date of Patent: Nov. 26, 2019

(54) WATERPROOFED ELECTRICAL CONNECTOR

(71) Applicants: Tetsuya Kifune, Tokyo (JP); Taro Mizue, Tokyo (JP); Takaki Tsutsui, Tokyo (JP)

(72) Inventors: Tetsuya Kifune, Tokyo (JP); Taro Mizue, Tokyo (JP); Takaki Tsutsui, Tokyo (JP)

(73) Assignee: MITSUMI ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/939,573

(22) Filed: Mar. 29, 2018

(65) Prior Publication Data

US 2018/0287290 A1 Oct. 4, 2018

(30) Foreign Application Priority Data

Mar. 30, 2017 (JP) ..... 2017-067591

(51) Int. Cl.
*H01R 13/52* (2006.01)
*H01R 13/6581* (2011.01)
(Continued)

(52) U.S. Cl.
CPC ..... *H01R 13/5202* (2013.01); *H01R 13/504* (2013.01); *H01R 13/506* (2013.01);
(Continued)

(58) Field of Classification Search
CPC ..... H01R 13/5202; H01R 13/5205; H01R 13/5219; H01R 13/5221; H01R 33/965
(Continued)

(56) References Cited

U.S. PATENT DOCUMENTS

2013/0183844 A1* 7/2013 Wang ..... H01R 24/68 439/271
2016/0149337 A1 5/2016 Ozaki et al.
(Continued)

FOREIGN PATENT DOCUMENTS

CN 205429282 U 8/2016
CN 205752743 U 11/2016
(Continued)

OTHER PUBLICATIONS

Extended European Search Report issued in EP 18164978.1 dated Oct. 9, 2018.

*Primary Examiner* — Abdullah A Riyami
*Assistant Examiner* — Justin M Kratt
(74) *Attorney, Agent, or Firm* — Brundidge & Stanger, P.C.

(57) ABSTRACT

A connector includes: a plurality of contacts each of which includes one end to be connected to a mating contact of a mating connector; a housing main body inside which a portion between the one end and the other end of each of the plurality of contacts is disposed, the housing main body being configured to support the plurality of contacts such that the plurality of contacts are disposed side by side; and an elastic sealing material to be provided on a side of the other end with respect to the housing main body in such a manner as to come into tight contact with peripheries of the plurality of contacts, the elastic sealing material serving as a seal against water ingress between the housing main body and the plurality of contacts from a side of the one end to the side of the other end.

5 Claims, 16 Drawing Sheets

(51) Int. Cl.

| | |
|---|---|
| ***H01R 13/506*** | (2006.01) |
| ***H01R 13/504*** | (2006.01) |
| ***H01R 13/6594*** | (2011.01) |
| *H01R 33/965* | (2006.01) |
| *H01R 12/72* | (2011.01) |
| *H01R 13/405* | (2006.01) |
| *H01R 13/6582* | (2011.01) |
| *H01R 24/60* | (2011.01) |
| *H01R 43/00* | (2006.01) |
| *H01R 43/24* | (2006.01) |
| *H01R 107/00* | (2006.01) |

(52) U.S. Cl.

CPC ..... *H01R 13/521* (2013.01); *H01R 13/6581* (2013.01); *H01R 13/6594* (2013.01); *H01R 12/724* (2013.01); *H01R 13/405* (2013.01); *H01R 13/5205* (2013.01); *H01R 13/5219* (2013.01); *H01R 13/5221* (2013.01); *H01R 13/6582* (2013.01); *H01R 24/60* (2013.01); *H01R 33/965* (2013.01); *H01R 43/005* (2013.01); *H01R 43/24* (2013.01); *H01R 2107/00* (2013.01)

(58) Field of Classification Search

USPC ..... 439/587, 271, 660, 676

See application file for complete search history.

(56) References Cited

U.S. PATENT DOCUMENTS

| | | | | |
|---|---|---|---|---|
| 2016/0294105 | A1* | 10/2016 | Zhao | H01R 13/5202 |
| 2017/0179634 | A1 | 6/2017 | Du et al. | |
| 2017/0288360 | A1* | 10/2017 | Zhao | H01R 13/5219 |
| 2017/0324186 | A1* | 11/2017 | Zhu | H01R 13/5202 |
| 2018/0269617 | A1* | 9/2018 | Zhang | H01R 13/6595 |

FOREIGN PATENT DOCUMENTS

| | | | |
|---|---|---|---|
| JP | 2015-005383 | A | 1/2015 |
| JP | 5916197 | B2 | 5/2016 |

* cited by examiner

WATERPROOFED ELECTRICAL CONNECTOR

CROSS REFERENCE TO RELATED APPLICATIONS

This application is entitled to and claims the benefit of Japanese Patent Application No. 2017-067591, filed on Mar. 30, 2017, the disclosure of which including the specification, drawings and abstract is incorporated herein by reference in its entirety.

TECHNICAL FIELD

The present invention relates to a waterproofed electronic part and connector.

BACKGROUND ART

Traditionally, casings of electronic devices, such as a mobile phone, personal digital assistant, portable music player, electronic book reader, and the like, have been desired to have a waterproof structure that prevents the ingress of rain water or the like. Various types of connectors are incorporated into such electronic devices for connecting the electronic devices to an external electronic device. Such connectors are also waterproofed in various ways in order to prevent water ingress into the casings of the electronic devices via these connectors.

In general, each of the connectors is fabricated from contact terminals and a metal shell by disposing the contact terminals in a housing made of resin and by surrounding the housing by the metal shell. In the connector, portions of the contact terminals on one end side are disposed in the casing and the other ends are disposed to be oriented toward the outside of the casing.

Because water (liquid) penetrates into a gap between components of the connector, such as between the contacts and the housing, between the housing and the shell, or the like due to the capillarity to ingress into the connector, waterproofing of the connector is carried out such that the capillarity is prevented.

For example, a molded connector of Patent Literature (hereinafter, referred to as "PTL") 1 is waterproofed and sealed by a waterproof sealing agent filled in a gap between contacts and a metal shell on one hand and a connector housing on the other hand.

In addition, in PTL 2, water ingress into a casing along contacts is prevented by filling a sealing material in a recessed reception portion at a rear portion of a connector and solidifying the sealing material within a shell. In this connector, the recessed reception portion has a bottom surface that corresponds to a rear surface of a housing, from which ends of the contacts protrude.

Another traditional connector having a structure in which contacts are knurled to lengthen the path of water ingress into the connector from ends of the contacts on the external side to the other ends of the contacts on the internal side, and thus, water ingress into the connector is made less possible is also known.

CITATION LIST

Patent Literature

PTL 1:
Japanese Patent No. 5916197

PTL 2:
Japanese Patent Application Laid-Open No. 2015-5383

SUMMARY OF INVENTION

Technical Problem

However, there is a risk in the connectors of PTLs 1 and 2 that aging or the like may cause a gap to be created between the waterproof sealing agent or sealing material that is filled in the gap between the contact and the housing, on one hand, and the place filled with the waterproof sealing agent or sealing material on the other hand. Because both of the waterproof sealing agent and sealing material are continuous with respective portions inside the casings, the water ingress into the casing is made easier when the gap is created.

Moreover, in the connector including the knurled contact, a knurling range needs to be physically long to a certain extent for lengthening of the path of water ingress at the contact, a knurled portion further needs to be long when the waterproofing effect is to be enhanced using this structure, and thus, the contact as a whole needs to be longer.

An object of the present invention is to provide an electronic part and a connector which can be miniaturized and in which it is ensured that water ingress into the electronic part and the connector can be prevented with a simple structure.

Solution to Problem

To achieve the above object, the present invention includes: a plurality of conductive members each of which includes one end to be connected to another electronic part; an insulator main body inside which a portion between the one end and the other end of each of the plurality of conductive members is disposed, the insulator main body being configured to support the plurality of conductive members such that the plurality of conductive members are disposed side by side; and an elastic sealing material to be provided on a side of the other end with respect to the insulator main body in such a manner as to come into tight contact with peripheries of the plurality of conductive members, the elastic sealing material serving as a seal against water ingress between the insulator main body and the plurality of conductive members from a side of the one end to the side of the other end.

In addition, the present invention includes: a plurality of contacts each of which includes one end to be connected to a mating contact of a mating connector; a housing main body inside which a portion between the one end and the other end of each of the plurality of contacts is disposed, the housing main body being configured to support the plurality of contacts such that the plurality of contacts are disposed side by side; and an elastic sealing material to be provided on a side of the other end with respect to the housing main body in such a manner as to come into tight contact with peripheries of the plurality of contacts, the elastic sealing material serving as a seal against water ingress between the housing main body and the plurality of contacts from a side of the one end to the side of the other end.

Advantageous Effects of Invention

According to the present invention, miniaturization can be achieved and it is ensured that water ingress can be prevented with a simple structure.

DESCRIPTION OF EMBODIMENTS

Hereinafter, an embodiment of the invention will be described in detail with reference to the accompanying drawings.

Figure 1:
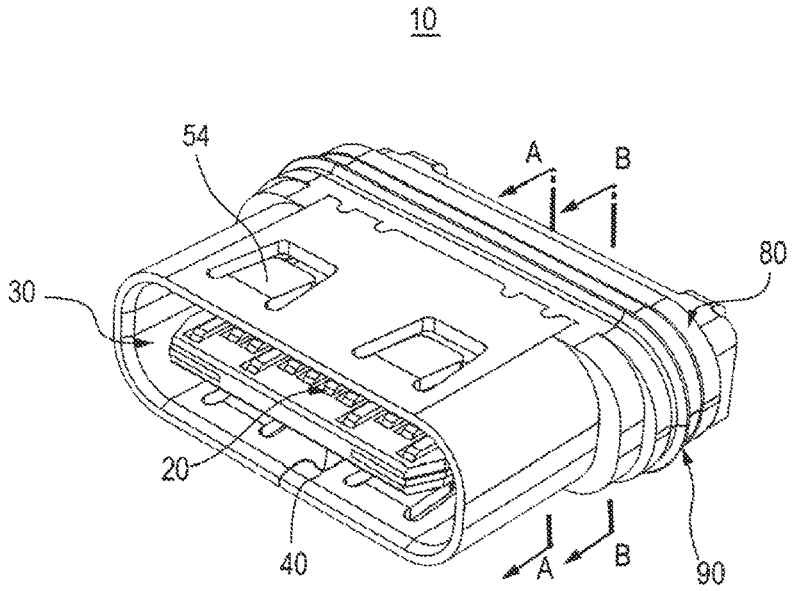
FIG. 1 illustrates a connector of one embodiment according to the present invention, as seen from the front end side of the connector.
Figure 2:
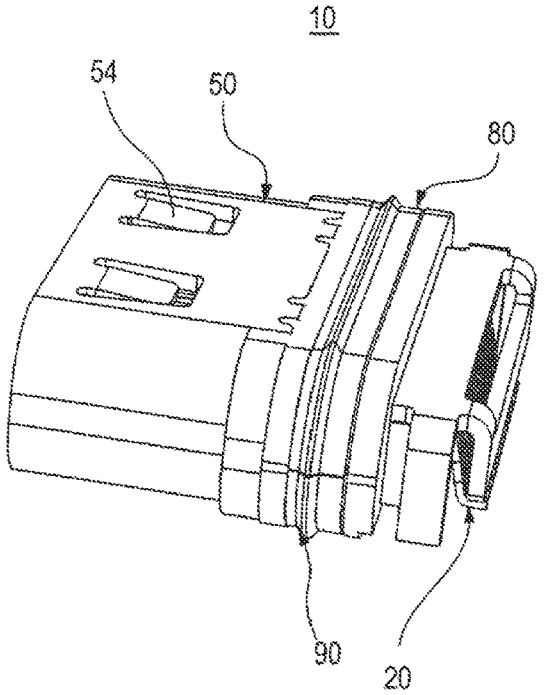
FIG. 2 illustrates the connector of one embodiment according to the present invention, as seen from the right side of rear end of the connector.
Figure 3:
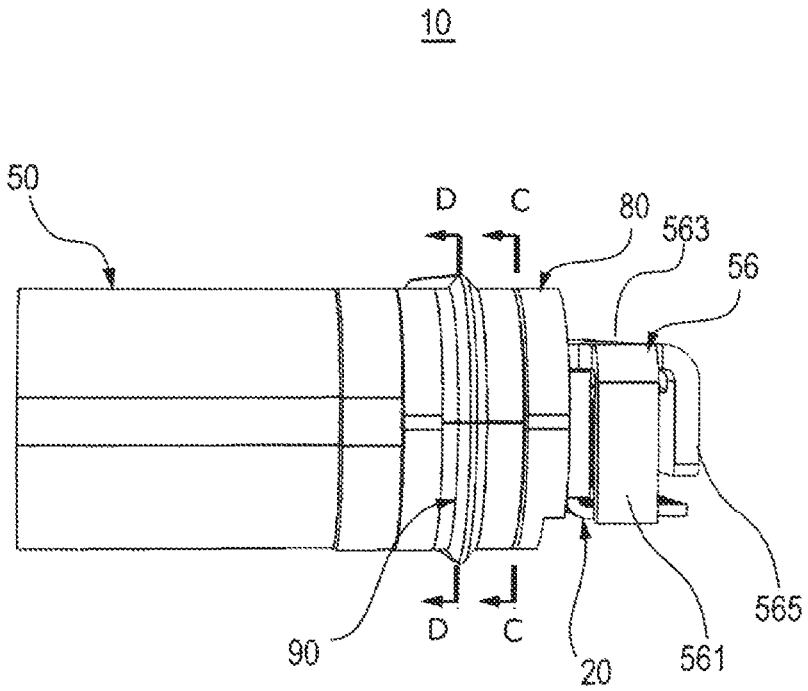
FIG. 3 illustrates the connector of one embodiment according to the present invention, as seen from the right side surface of the connector.
Figure 4:
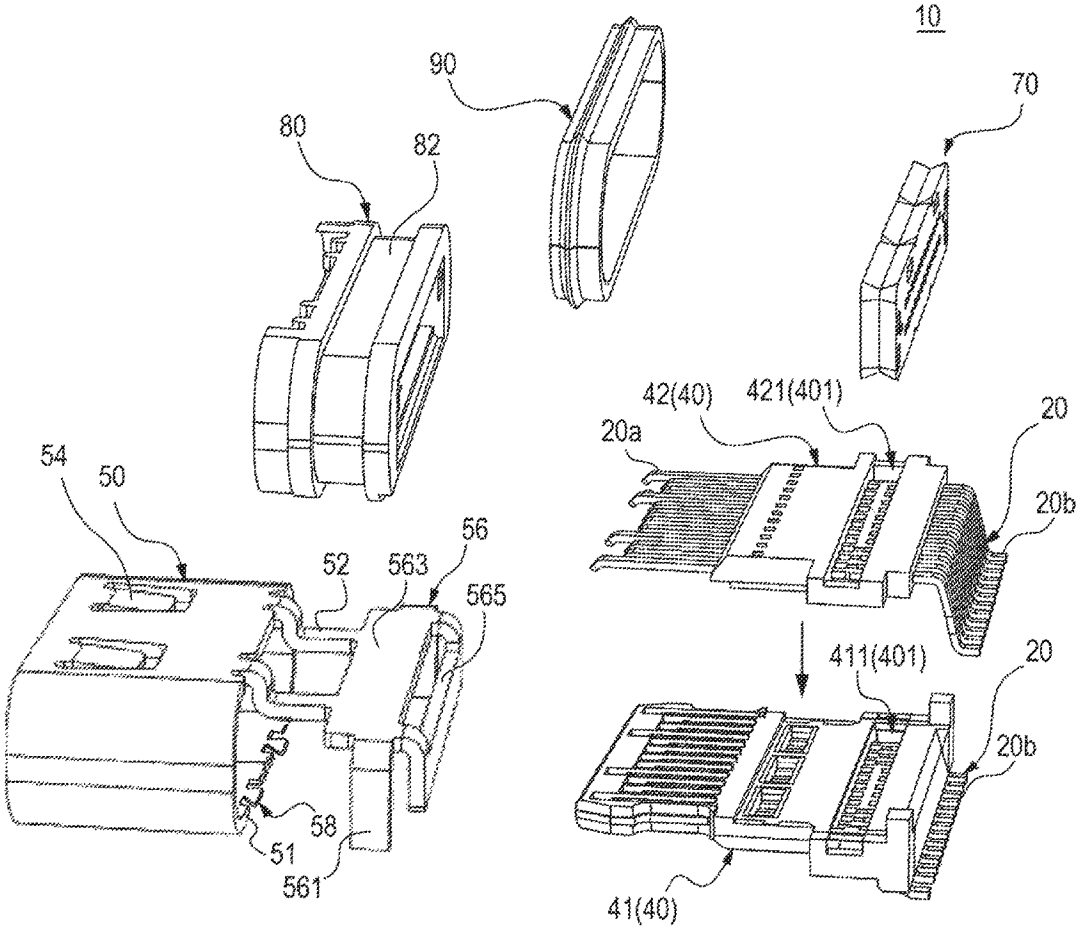
FIG. 4 is an exploded view illustrating a structure of principal parts of the connector of one embodiment according to the present invention.
Figure 5:
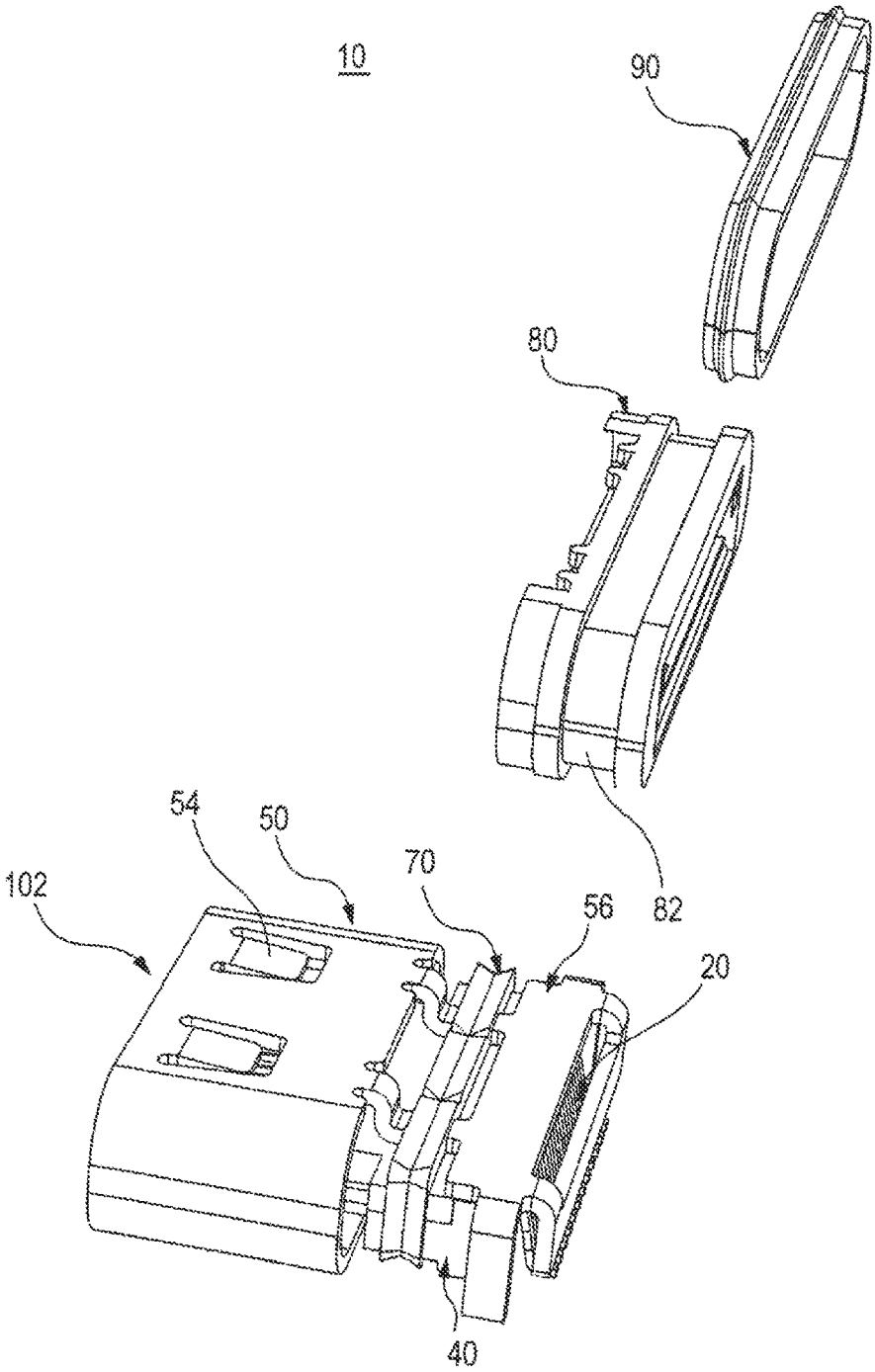
FIG. 5 is an exploded perspective view of a main connector part corresponding to a part of the connector of one embodiment according to the present invention from which a gasket and an outer mold are detached.
Figure 6A:
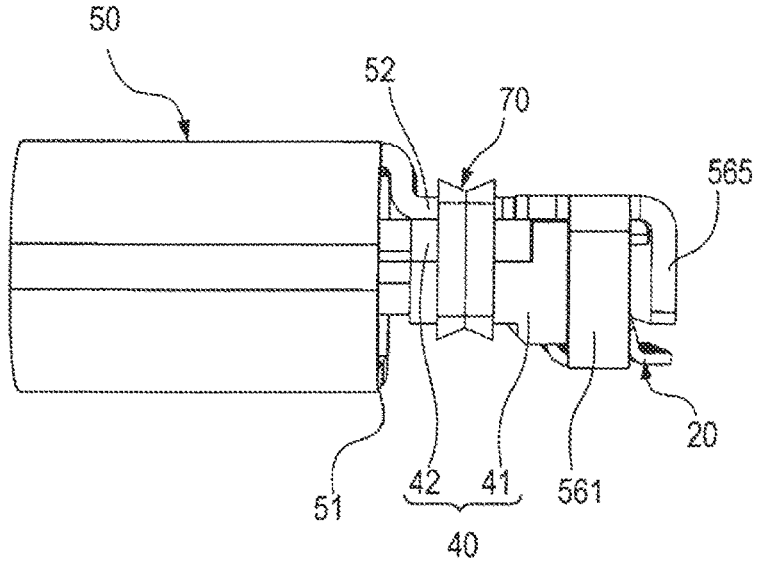
FIG. 6A illustrates the main connector part, particularly the right side surface of the main connector part.
Figure 6B:
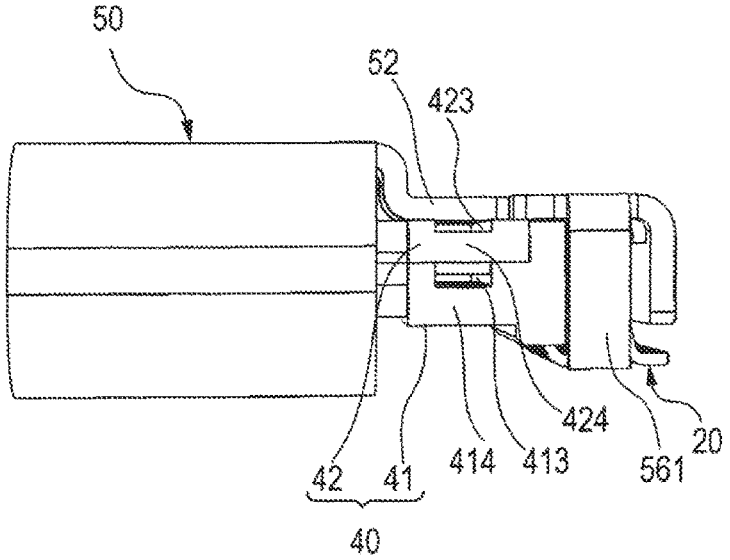
FIG. 6B illustrates the main connector part, particularly the right side surface of the main connector part from which an elastic sealing material is detached.

FIG. 1 illustrates a connector of one embodiment according to the present invention, as seen from the front end side of the connector, FIG. 2 illustrates the connector of one embodiment according to the present invention, as seen from the right side of rear end of the connector, and FIG. 3 illustrates the connector of one embodiment according to the present invention, as seen from the right side surface of the connector. In addition, FIG. 4 is an exploded view illustrating a structure of principal parts of the connector of one embodiment according to the present invention, FIG. 5 is an exploded perspective view of a main connector part corresponding to a part of the connector of one embodiment according to the present invention from which a gasket and an outer mold are detached, FIG. 6A illustrates the main connector part, particularly the right side surface of the main connector part; and FIG. 6B illustrates the main connector part, particularly the right side surface of the main connector part from which an elastic sealing material is detached. Note that, expressions related to directions, such as front, rear, right, and left as used in the embodiment of the present invention are not absolute, but relative, and these expressions respectively mean the front surface, rear surface, right side surface, and left side surface as seen from the side of a connector portion to be connected to a mating connector.

<Entire Structure of Connector 10>

Connector 10 of the embodiment according to the present invention is a waterproofed connector, so-called waterproof connector, and is used for electronic device 200 (see FIG. 25), such as a mobile phone, personal digital assistant, portable music player, electronic book reader, or the like, for example. The connector according to the embodiment of the present invention may be a waterproof connector such as that conforming to USB standards. For example, the connector of the embodiment of the present invention is applicable as the USB Type-C connector or the like.

Connector 10 illustrated in FIGS. 1 to 4 is an electronic part, and includes a plurality of contacts 20 as conductive members, housing 40, shell 50, elastic sealing material 70, outer mold 80, and gasket 90.

In connector 10, cylindrical shell 50 is disposed to the outer periphery of the front end of housing 40 supporting contacts 20, and elastic sealing material 70 is disposed to a part of housing 40 in such a manner as to surround respective portions of contacts 20 while in tight contact with these portions, as illustrated in FIGS. 1 to 6. Elastic sealing material 70 encloses therein portions of coupling arms 52 protruding from shell 50 on the rear end side of shell 50. Outer mold 80 is provided to the outer periphery of elastic sealing material 70, and gasket 90 is attached to the outer surface of outer mold 80.

<Structure of Principal Parts of Connector 10>

Each of the plurality of contacts 20 is a long filamentary material made of a highly conductive metal and includes one end 20*a* to be connected to a contact of a mating connector (another electronic part) and other end 20*b* to be connected to a connection target for the mating connector.

Contacts 20 are supported by housing 40 such that one ends 20*a* respectively including contact points are disposed on the front end side, other ends 20*b* are disposed on the rear end side, and contacts 20 are spaced from each other in the right-left direction at predetermined intervals. The plurality of contacts 20 are composed of two upper and lower rows of contacts and the upper and lower rows of contacts are disposed symmetrically in housing 40 in the embodiment of the present invention. However, the present invention is not limited to this embodiment, and a plurality of contacts 20 composed of one row of contacts or three or more rows of contacts may be disposed in housing 40. In addition, the number of contacts in each of the rows may be any number.

Figure 7:
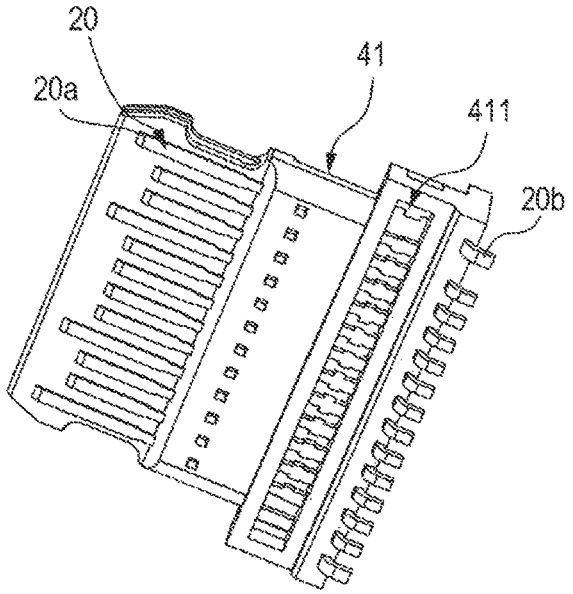
FIG. 7 illustrates a bottom housing as seen from below.
Figure 8:
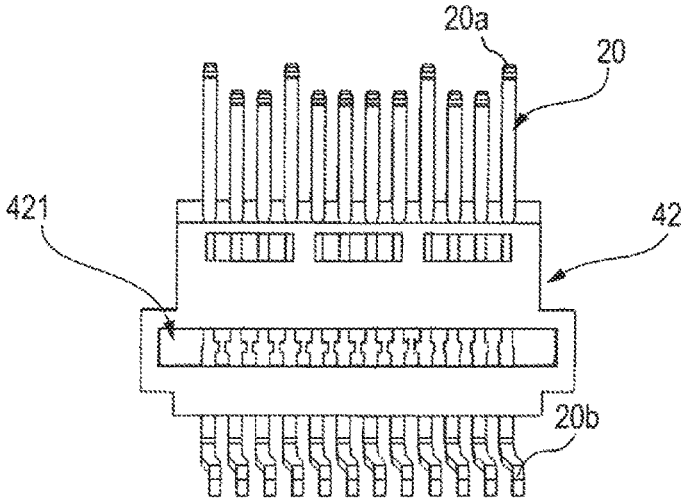
FIG. 8 is a bottom view of a top housing.

FIG. 7 illustrates bottom housing 41 as seen from below, and FIG. 8 is a bottom view of top housing 42.

Housing 40 includes bottom housing 41 and top housing 42 in the embodiment of the present invention, as illustrated in FIGS. 4 and 6 to 8. Note that, in the embodiment of the present invention, housing 40 corresponds to an insulator, and a portion of housing 40 enclosing therein portions respectively between one ends 20*a* and other ends 20*b* of contacts 20 corresponds to a front end of housing 40 and corresponds to an insulator main body (housing main body). Housing 40 supports the plurality of contacts 20 by entire housing 40 including the insulator main body corresponding to the front end of housing 40 such that the plurality of contacts 20 are disposed side by side.

As illustrated in FIGS. 4 and 7, bottom housing 41 is flat and platelike and is formed to create a watertight structure in which multiple contacts 20 of the lower row are fit in multiple grooves extending in the front-rear direction.

Bottom housing 41 is formed from a polyamide-based resin, for example, Nylon®. Bottom housing 41 and the lower row of contacts 20 are formed integrally using insert molding in the present embodiment. This brings bottom housing 41 and those contacts 20 supported by bottom housing 41 into tight contact with each other.

Through hole 411 extending perpendicular to the extending direction of contacts 20, that is, to the longitudinal direction is formed in bottom housing 41. In this embodiment, through hole 411 is formed perpendicular to the extending direction of contacts 20 and formed in the form of a slit. In through hole 411, contacts 20 are provided to cross through hole 411 in the transverse direction of through hole 411, and are exposed to the outside in bottom housing 41. These contacts 20 within through hole 411 are each formed to be provided with protrusions at the outer surface of contact 20 so that the width of contact 20 is not constant for lengthening the distance of contact 20 in the longitudinal direction and accordingly the water ingress is made less possible.

In addition, as illustrated in FIGS. 4 and 8, top housing 41 is flat and platelike and is formed to create a watertight structure in which multiple contacts 20 of the upper row are fit in multiple grooves extending in the front-rear direction.

Figure 11:
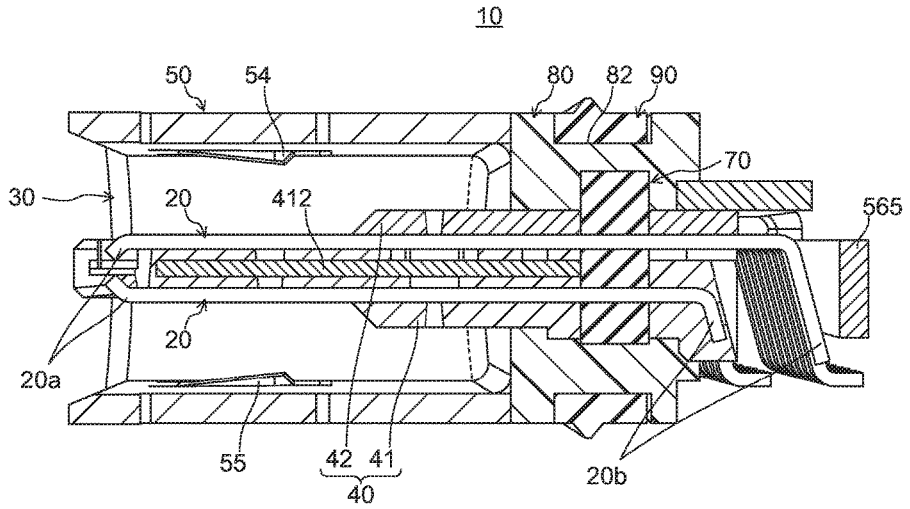
FIG. 11 is a sectional view taken along line A-A in FIG. 1.
Figure 12:
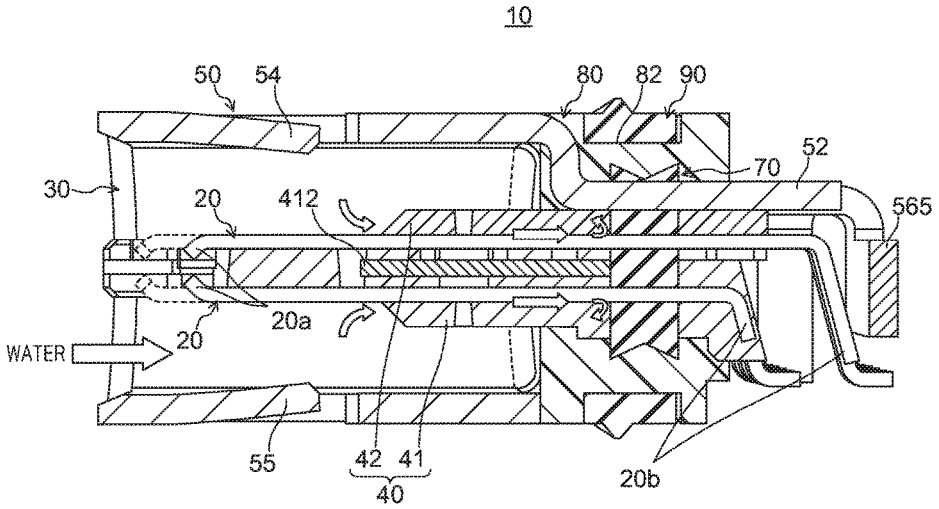
FIG. 12 is a sectional view taken along line B-B in FIG. 1.

Note that, platelike reinforcing board 412 adapted to reinforce the front end side of bottom housing 41 (that is, of housing 40) is provided inside bottom housing 41 on the front end side (see FIGS. 11 and 12). With this reinforcing board 412, insertion of connector 10 into a mating connector can easily be guided and thus the contacts of both of the connectors can easily be connected to each other without causing bottom housing 41 to be bent on the front end side when connector 10 is fit in the mating connector and the front end side of bottom housing 41 is inserted in a recess in the mating contact.

Top housing 42 is formed from a polyamide-based resin, for example, nylon. Top housing 42 and the upper row of contacts 20 are formed integrally using insert molding in the present embodiment. This brings top housing 42 and those contacts 20 supported by top housing 42 into tight contact with each other.

Through hole 421 extending perpendicular to the extending direction of contacts 20, that is, to the longitudinal direction is formed in top housing 42. In this embodiment, through hole 421 is formed perpendicular to the extending direction of contacts 20 and formed in the form of a slit. In through hole 421, contacts 20 are provided to cross through hole 411 in the transverse direction of through hole 421, and are exposed to the outside in top housing 42. These contacts 20 within through hole 421 are each formed to be provided with protrusions at the outer surface of contact 20 so that the width of contact 20 is not constant for lengthening the distance of contact 20 in the longitudinal direction and accordingly the water ingress is made less possible.

Housing 40 is formed by placing these bottom and top housings 41 and 42 on each other, as illustrated in FIGS. 4 and 6. When bottom and top housings 41 and 42 are placed on each other, through holes 411 and 421 formed to correspond to each other form opening 401 passing through housing 40 in the up-down direction in a portion of housing 40 on the rear end side.

The plurality of contacts 20 are disposed crosswise in opening 401 in housing 40. Elastic sealing material 70 is provided in opening 401, and each of contacts 20 in opening 401 is covered by elastic sealing material 70 while the periphery of contact 20 (the outer periphery of contact 20 in opening 401) is in tight contact with elastic sealing material 70.

In addition, gutter portions 413 and 423 are formed in the upper surfaces of both side wall portions 414 and 424 of through holes 411 and 421 in bottom and top housings 41 and 42 in such a manner as to extend laterally through side wall portions 414 and 424, respectively, as illustrated in FIG. 6B.

Figure 9:
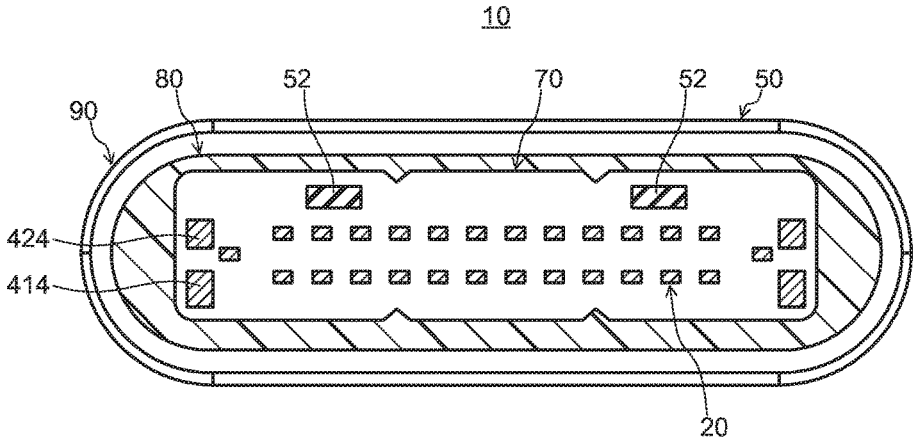
FIG. 9 is a sectional view taken along line C-C and seen in the direction indicated by the arrows in FIG. 3.
Figure 10:
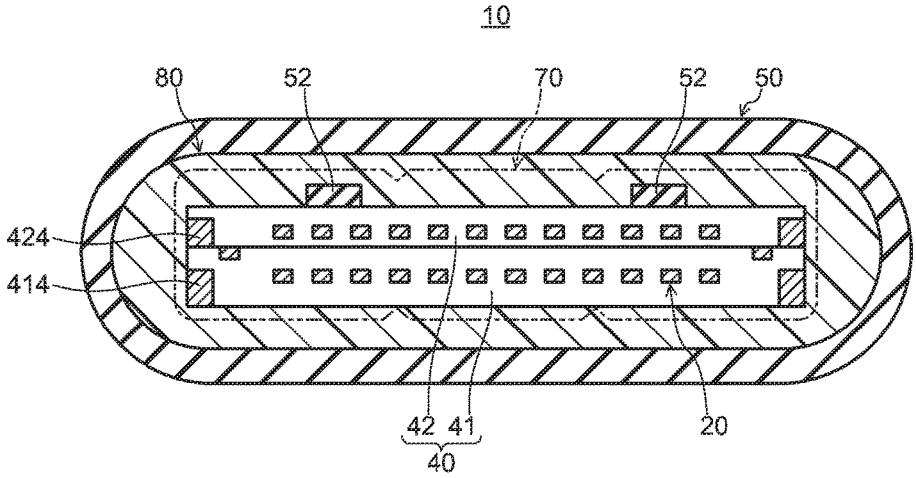
FIG. 10 is a sectional view taken along line D-D and seen in the direction indicated by the arrows in FIG. 3.

FIG. 9 is a sectional view taken along line C-C and seen in the direction indicated by the arrows in FIG. 3, and FIG. 10 is a sectional view taken along line D-D and seen in the direction indicated by the arrows in FIG. 3.

As illustrated in FIGS. 4 to 6, 9, and 10, elastic sealing material 70 comes into tight contact with and covers, on the rear end side of housing 40, portions of housing 40 and contacts 20 supported by housing 40, that is, the outer peripheries of the portions of housing 40 and contacts 20 around which elastic sealing material 70 is disposed.

Elastic sealing material 70 is formed from elastic soft resin, such as an elastomeric resin or the like. Elastic sealing material 70 is formed, for example, from polyester-based thermoplastic elastomer (TPEE). Elastic sealing material 70 is rectangular, has a predetermined thickness (length in the front-rear direction of connector 10), and is formed by molding in the embodiment of the present invention.

As illustrated in FIGS. 4 to 6, 9, and 10, elastic sealing material 70 encloses portions between one ends 20*a* and other ends 20*b* of contacts 20 while being in tight contact with the outer peripheries of these portions. Elastic sealing material 70 also encloses portions of bottom and top housings 41 and 42 positioned between one ends and the other ends of contacts 20 (both side wall portions 414 and 424) while being in tight contact with these portions.

In this way, elastic sealing material 70 encloses portions of housing 40 while being in tight contact with the peripheries of these portions; these portions are portions (side wall portions 414 and 424 having gutter portions 413 and 423 at their tops, respectively) at which one portion of housing 40 on the one end side, which corresponds to the housing main body, is connected to the other portion of housing 40 on the rear end side. Elastic sealing material 70 also encloses portions of coupling arms 52 protruding from the rear edge of upper surface of shell 50 while being in tight contact with these portions.

In this way, in connector 10, elastic sealing material 70 is disposed perpendicular to the extending direction of connector 10 and disposed on the outer peripheral surfaces of all members of connector 10 that extend on the sides of one end 20*a* and other end 20*b* and that can be paths of water ingress from the outside into the inside of connector 10, so as to block the paths of water ingress.

Note that, elastic sealing material 70 may have any shape which allows elastic sealing material 70 to be provided between one ends (front ends) 20*a* and other ends (base ends) 20*b* of contacts 20, to come into tight contact with the outer surfaces of contacts 20, and to prevent water ingress due to the capillarity along the outer surfaces of contacts 20 from the front end side to the base end side.

Examples of modified elastic sealing material 70 are illustrated in FIGS. 13 to 17.

Figure 13:
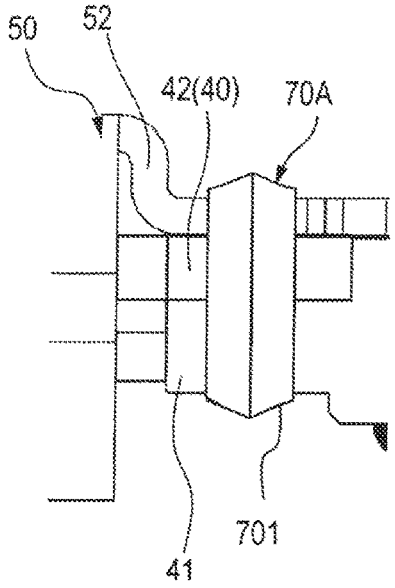
FIG. 13 illustrates Modification 1 of the elastic sealing material.
Figure 14:
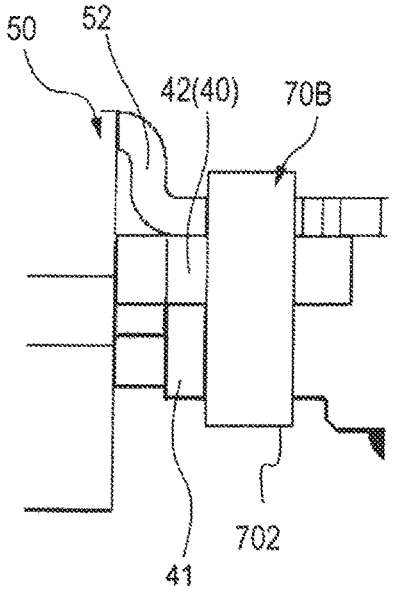
FIG. 14 illustrates Modification 2 of the elastic sealing material.

Outer surface 701 of elastic sealing material 70A illustrated in FIG. 13 is formed in the shape of a mountain having a peak in the middle portion in the front-rear direction. Outer surface 702 of elastic sealing material 70B illustrated in FIG. 14 is formed flat.

Figure 15:
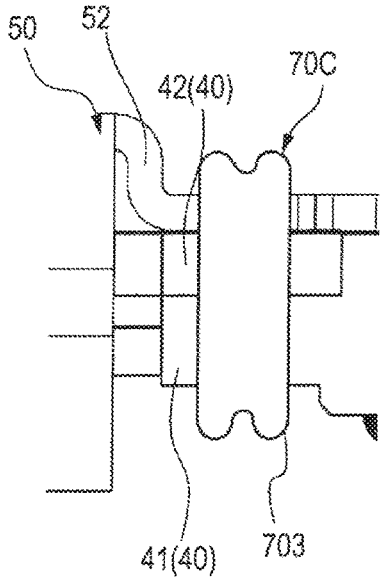
FIG. 15 illustrates Modification 3 of the elastic sealing material.
Figure 16:
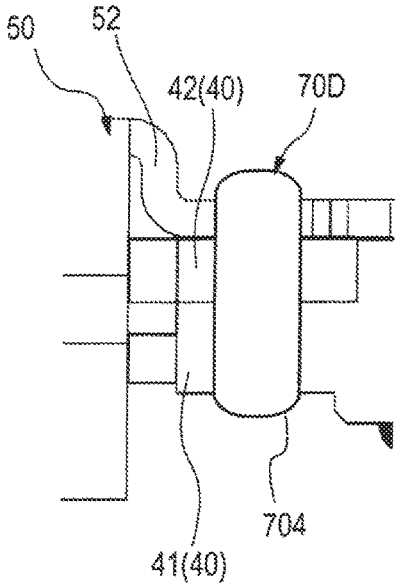
FIG. 16 illustrates Modification 4 of the elastic sealing material.
Figure 17:
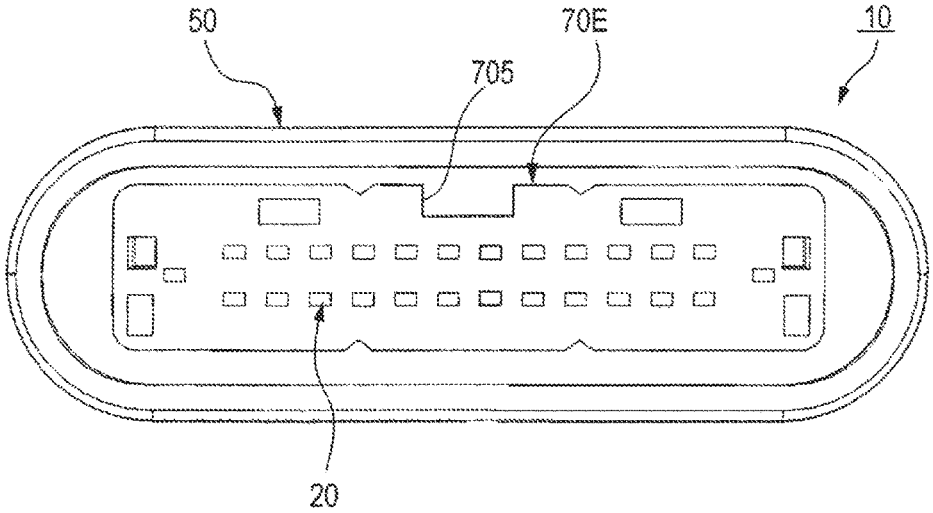
FIG. 17 is a rear view of Modification 5 of the elastic sealing material.

Outer surface 703 of elastic sealing material 70C illustrated in FIG. 15 is formed by a plurality of curved surfaces. Outer surface 704 of elastic sealing material 70D illustrated in FIG. 16 is a curved surface. As for the shape of elastic sealing material 70E illustrated in FIG. 17, cutout 705 is formed in a part of the outer surface.

Every one of elastic sealing materials 70A to 70E can produce the same effect as elastic sealing material 70. In particular, elastic sealing materials 70A, 70C, and 70E illustrated in FIGS. 13, 15, and 17 have a deformed shape such as a protrusion at a part of the outer surface or the like, so that respective outer molds 80 for covering these elastic sealing materials 70A, 70C, and 70E can be interlocked easily with and joined firmly to these elastic sealing materials 70A, 70C, and 70E when outer molds 80 are provided by molding.

Figure 18:
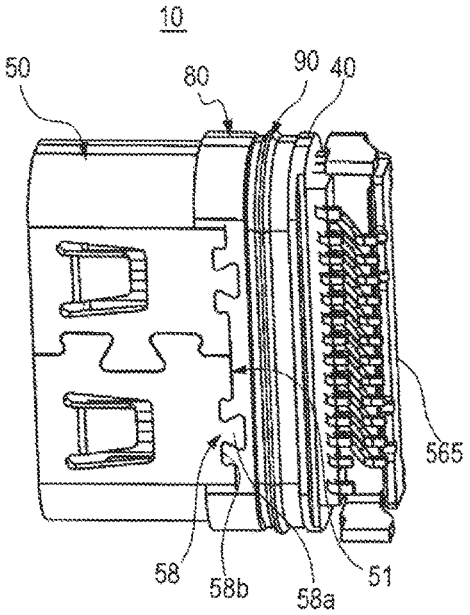
FIG. 18 illustrates the connector of one embodiment according to the present invention, as seen from below.

FIG. 18 illustrates the connector of one embodiment according to the present invention, as seen from below.

As illustrated in FIGS. 1 to 6 and 9 to 12, shell 50 is cylindrical and, as for shell 50 formed, for example, by processing a flat metal plate is conductive in the embodiment of the present invention.

Shell 50 is disposed to surround the front end side of housing 40 supporting contacts 20, and a mating connector (for example, plug) is inserted from the side of an opening of shell 50. To be more specific, shell 50 is disposed to the outer periphery of the front end (insulator main body) of housing 40 enclosing respective portions of contacts 20 between one ends 20*a* and other ends 20*b* of contacts 20, and covers the front end of the housing 40. Shell 50 includes opening 30 in which a mating connector being a connection target for contacts 20 is inserted.

As illustrated in FIGS. 1 to 6, 9 to 12, and 18, shell 50 includes, at a pair of mutually opposing surfaces (the upper and lower surfaces of shell 50 in the embodiment of the present invention), plate springs (shell springs) 54 and 55 formed by cutting the upper and lower surfaces and by causing the cut upper and lower surfaces to stand inward.

Shell springs 54 and 55 are adapted to be engaged with a shell of the mating connector when connector 10 is connected to the mating connector. Shell 50 is grounded on a substrate or the like (not illustrated) via legs formed continuously from the rear end of shell 50. Shell 50 in the embodiment of the present invention is provided with rear shell portion 56 continuously via coupling arms 52 protruding rearward from shell 50 on the rear end side.

Figure 19:
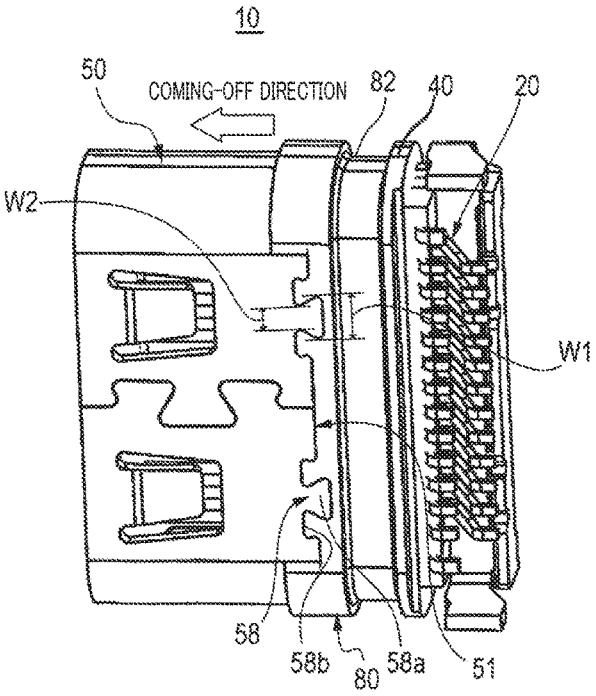
FIG. 19 is an explanatory view of interlocking portions of the connector illustrated in FIG. 18 from which the gasket is detached.

Shell 50 includes, at rear edge 51, interlocking portions 58 formed to be interlocked with outer mold 80 so as to prevent shell 50 from coming off outer mold 80 (see FIGS. 18 and 19).

In the embodiment of the present invention, each of interlocking portions 58 is rugged and includes protrusion 58*a* and recesses 58*b*, and is formed to be coupled with outer mold 80 by means of a so-called dovetail joint. The details about this interlocking portion 58 are described below.

Rear shell portion 56 includes main plate portion 563 continuing from coupling arms 52, legs 561 extending downward from main plate portion 563, and back shield portion 565.

Main plate portion 563 is formed to cover the rear ends of contacts 20 at a position above the rear ends of contacts 20. Main plate portion 563 is located lower than the upper surface of shell 50 as is apparent from FIG. 4. With this structure, the outer surface of outer mold 80, outer mold 80 being adapted to surround coupling arms 52 that are located as high as main plate portion 563, can be made substantially flush with the outer surface of shell 50, so that connector 10 can be miniaturized without an increase in outer diameter of connector 10 being caused.

Top housing 42 of housing 40 is disposed along the undersurfaces of coupling arms 52. Accordingly, coupling arms 52 function as a positioning guide during insertion of housing 40 into shell 50.

Legs 561 serve as legs for fixation in attaching connector 10 to a mounting board or the like, and can be connected to a ground on the mounting board to ground shell 50.

Back shield portion 565 is formed by bending downward a platelike portion extending out from the rear part of main plate portion 563.

That is, shell 50 has a function of covering the outer periphery of housing 40, and also covers the rear end side of contacts 20 with back shield portion 565 at the rear portion of connector 10 so as to allow improvement of noise immunity of connector 10.

<Interlocking Portion 58>

FIG. 19 is an explanatory view of interlocking portions 58 of connector 10 illustrated in FIG. 18 from which gasket 90 is detached.

As illustrated in FIG. 19, in each of interlocking portions 58, protrusion 58*a* has a size (W1) in the direction perpendicular to the coming-off direction on the front end side and a size (W2) in the direction perpendicular to the coming-off direction on the rear end side, and size W1 is greater than size W2. This makes it possible to prevent the relative movement of outer mold 80 and shell 50 in the coming-off direction (in the direction indicated by the arrow illustrated in FIG. 19) because outer mold 80 comes to have a corresponding interlocking shape when formed from resin (for example, nylon) by out-mold molding.

Interlocking portion 58 may have any shape which restricts the relative movement of shell 50 and outer mold 80 in the coming-off direction.

Figure 20:
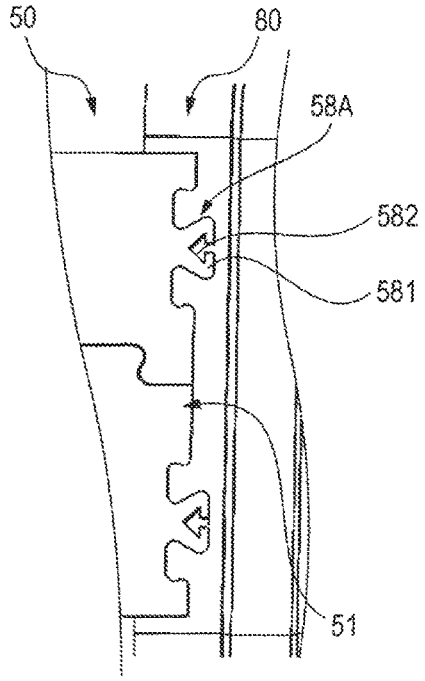
FIG. 20 is an explanatory view of Modification 1 of the state where the outer mold and the shell are interlocked.

Interlocking portion 58A of Modification 1 illustrated in FIG. 20 includes, in protrusion 581 of shell 50, recess 582 that is open on the side of outer mold 80. Recess 582 is formed in the shape of an inverse arrow and a protrusion of outer mold 80 that is to be fit in this recess 582 is formed in the shape of an arrow, so that outer mold 80 is engaged with recess 582 by an arrowhead portion of the protrusion of outer mold 80 and the relative movement in the coming-off direction is restricted.

Figure 21:
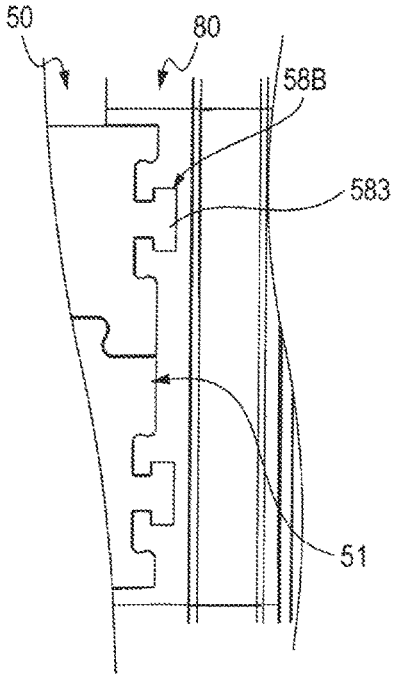
FIG. 21 is an explanatory view of Modification 2 of the state where the outer mold and the shell are interlocked.

In interlocking portion 58B of Modification 2 illustrated in FIG. 21, protrusion 583 of shell 50 is T-shaped and, at the tip end of protrusion 583, a straight portion projecting rightward and leftward to extend perpendicular to the protruding direction of protrusion 583 is formed. A recess in outer mold 80 to be engaged with this protrusion 583 has a bent shape like a hook at the opened edge portion of the recess, so that shell 50 and outer mold 80 are engaged with each other and the relative movement in the coming-off direction is restricted.

Figure 22:
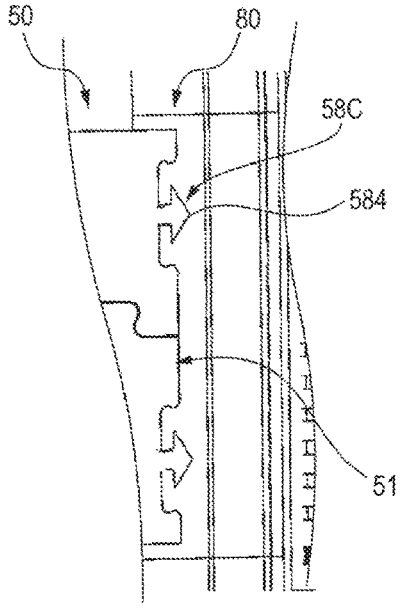
FIG. 22 is an explanatory view of Modification 3 of the state where the outer mold and the shell are interlocked.

Further, in interlocking portion 58C of Modification 3 illustrated in FIG. 22, protrusion 584 of shell 50 has a size in the widthwise direction (in the right-left direction of the connector) greater on the base end side than on the front end side. That is, protrusion 584 is formed in the shape of an arrow pointing the side of outer mold 80. Accordingly, a portion of outer mold 80 is engaged with the arrowhead portion of arrow-shaped protrusion 584, so that shell 50 and outer mold 80 are engaged with each other and the relative movement in the coming-off direction is restricted.

Figure 23:
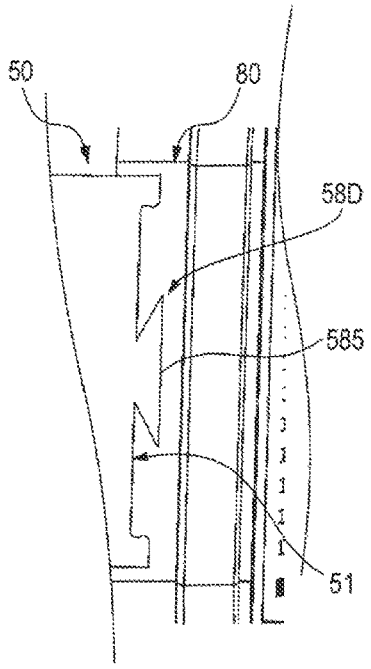
FIG. 23 is an explanatory view of Modification 4 of the state where the outer mold and the shell are interlocked.

As illustrated in interlocking portion 58D of Modification 4 in FIG. 23, protrusion 585 of shell 50 may be formed in the shape of an inverse triangle or the like. In this case, the recess of outer mold 80 is engaged with this protrusion 585, so that shell 50 and outer mold 80 are engaged with each other and the relative movement in the coming-off direction is restricted.

In this way, protrusions 58*a*, 581, 583, 584, and 585 of interlocking portions 58 and 58A to 58D may have any shape which allows the interlocking portion to be engaged with a mating recess such that the relative movement in the coming-off direction is restricted. This prevents shell 50 from coming off outer mold 80.

In main connector part 102, outer mold 80 is disposed between shell 50 and rear shell portion 56 in a solid state in such a manner as to surround elastic sealing material 70, and is formed integrally with housing 40.

Outer mold 80 is formed from a polyamide-based resin, for example, Nylon® and is provided by molding in the embodiment of the present invention to encapsulate elastic sealing material 70.

The outer surface of outer mold 80 is formed substantially flush with the outer surface of shell 50.

Annular recess 82 is formed in the outer surface of outer mold 80 in the circumferential direction, and gasket 90 is attached to the outside of this recess 82. Gasket 90 allows airtight attachment of connector 10 to an opening of an electronic device, which is a connector attachment port, (for example, opening 220 in FIG. 25) when connector 10 is attached to this opening.

Note that, although the number of coupling arms 52 is two in the embodiment of the present invention, the present invention is not limited to this number and the number of coupling arms 52 may also be one. Coupling arms 52 in the embodiment of the present invention are disposed to overlap particularly with some of contacts 20 that transmit high speed signals, in which case coupling arms overlap with such contacts 20 in the extending direction of such contacts 20. This makes it possible to remove noise (EMI) during transmission and reception of the high speed signals, for example.

<Example of Method for Producing Connector>

Connector 10 of the embodiment of the present invention can be produced using any suitable method for producing connector 10.

FIG. 24 illustrates a method for assembling the connector of one embodiment according to the present invention. To begin with, for example, bottom housing 41 and top housing 42 are produced by disposing contacts 20 corresponding to metal molds (not illustrated) of bottom housing 41 and top housing 42, respectively, and by pouring resin, such as a nylon resin or the like, into the peripheries of contacts 20 to perform insert molding.

In addition, shell 50 with rear shell portion 56 is produced by processing a metal plate. The back shield and legs as well as rear shell portion 56 is flat and platelike. Bottom housing 41 and top housing 42 are joined to form housing 40, and housing 40 is inserted into shell 50 from the rear side of shell 50 (see FIG. 24A).

Then, elastic sealing material 70 is formed from an elastomeric resin by molding to close opening 401 of housing 40.

At this time, the resin flows through gutter portions 413 and 423 formed in the upper surface of both side wall portions 414 and 424 of through holes 411 and 421 that form opening 401 in bottom housing 41 and top housing 42 of housing 40, and opening 401 is filled with the resin. In this way, elastic sealing material 70 in tight contact with the outer peripheries of all the contacts 20 within opening 401 is formed by molding. In addition, elastic sealing material 70 is provided in such a manner as to surround parts of the outer peripheries of coupling arms 52 extending from shell 50, to be in tight contact with those parts, and to be solid. In this way, all the portions that can be a path of water ingress into connector 10 from the front end side to the rear end side of connector 10 are blocked by a single molding process.

Figure 24A:
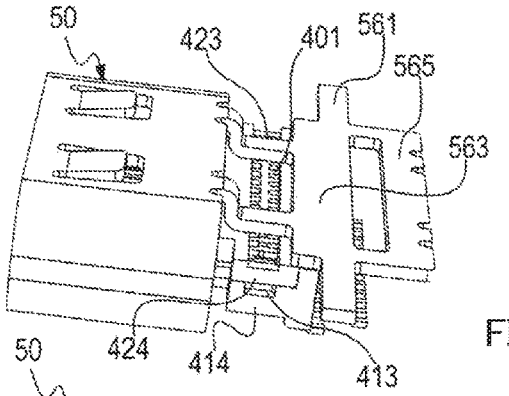
FIG. 24A-D illustrate a method for assembling the connector of one embodiment according to the present invention.
Figure 24B:
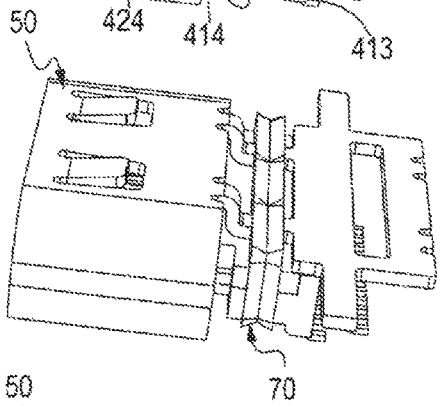
Figure 24C:
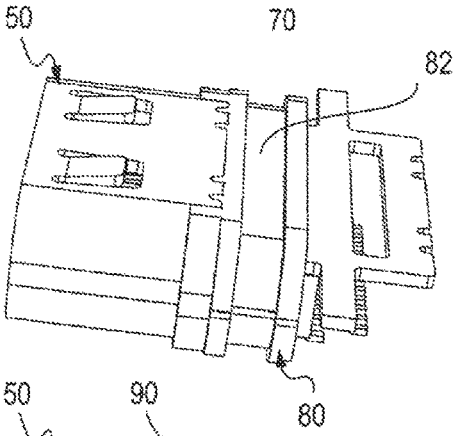

Then, outer mold 80 is formed by molding to encapsulate elastic sealing material 70 as illustrated in FIG. 24C. At this time, outer mold 80 is formed by molding to conform to interlocking portions 58 of shell 50, and is thus formed to restrict movement in the coming-off direction.

Figure 24D:
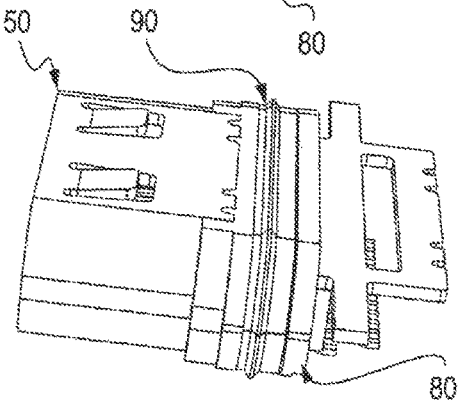

Then, gasket 90 is attached to the outside of recess 82 in outer mold 80 as illustrated in FIG. 24D. Subsequently, back shield portion 565 and legs 561 are bent downward. Connector 10 is thus formed.

According to connector 10 of the embodiment of the present invention, when a large amount of water ingresses first through the opening as illustrated in FIG. 12, the water attached to housing 40 (in particular, to bottom housing 41 and top housing 42) in shell 50 may ingress into the gaps between housing 40 and contacts 20 due to capillarity in a region of housing 40 that holds contacts 20. This occurs even when housing 40 and contact 20 are brought into tight contact with each other by insert molding. In addition, water may travel along shell 50 to ingress into connector 10 on its rear end side.

The water that ingresses into the gaps between housing 40 and contacts 20 moves toward the rear end side, that is, moves inward within the gaps along contacts 20 and portions of housing 40 facing contacts 20. However, in connector 10, elastic sealing material 70 interrupts the continuity of the gaps extending in the front-rear direction between housing 40 and contacts 20, so that it is possible to prevent inward water ingress, and therefore, the water ingress into connector 10 does not occur.

In this way, the length of the connector in the front-rear direction can be reduced and it is ensured that the water ingress into the connector can be prevented in comparison with the traditional structures in which a path of water ingress is lengthened to prevent the water ingress into the connector.

Figure 25:
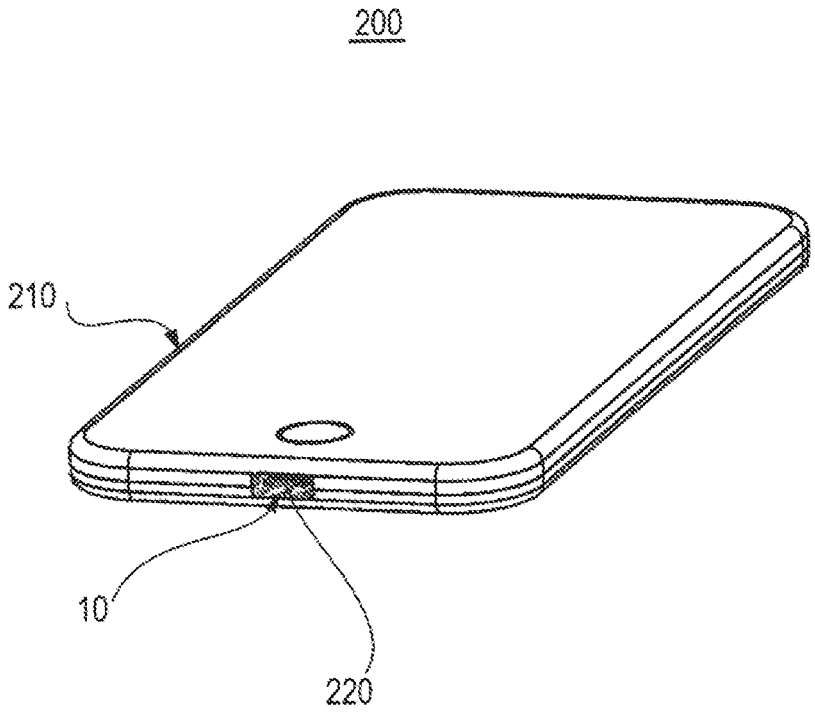
FIG. 25 illustrates an electronic device in which the connector of one embodiment according to the present invention is mounted.

FIG. 25 is a perspective view of electronic device 200 provided with connector 10 of the embodiment of the present invention.

Electronic device 200 includes hollow device casing 210 and connector 10.

Device casing 210 is formed to include a sealed hollow portion; for example, includes upper and lower casings and a packing tightly held between the mating surfaces of the upper and lower casings. Device casing 210 includes opening 220 for a connector to be disposed therein that is formed in the outer surface of device casing 210, and connector 10 is disposed in this opening 220.

Connector 10 is disposed in opening 220 such that the opening in connector 10 is oriented outward, and is attached to device casing 210 by gasket 90 in an airtight manner.

In electronic device 200, device casing 210 is sealed and connector 10 is fixed in opening 220 via gasket 90, so that water, dust, or the like does not ingress into electronic device 200 between device casing 210 and connector 10.

In addition, in the inside of connector 10, possible paths of water ingress into connector 10 due to capillarity, such as contacts 20, coupling arms of shell 50, and the like, are blocked by elastic sealing material 70 encapsulated in outer mold 80 to which gasket 90 is fit as described above. This makes it possible to improve further the waterproofness of electronic device 200 provided with connector 10. According to connector 10, it is thus possible to achieve miniaturization and to prevent water ingress with a simple structure.

The embodiment disclosed herein is merely an exemplification in every respect and should not be considered as limitative. The scope of the present invention is specified by the claims, not by the above-mentioned description. The scope of the present invention is intended to include all modifications in so far as they are within the scope of the appended claims or the equivalents thereof.

The embodiments of the invention have been described above. The above description is an illustration of the preferred embodiment of the present invention, and the scope of the present invention is not limited to the description. That is, the description for the construction of the above-mentioned device and for the shape of each part is an example, and it is clear that various modifications and additions to the example can be made within the scope of the present invention.

INDUSTRIAL APPLICABILITY

An electronic part and a connector according to the present invention produce an effect in which it is ensured that water ingress into the electronic part or the connector can be prevented with a simple structure, and the electronic part and the connector are useful as a waterproof connector.

REFERENCE SIGNS LIST

10 Connector
20 Contact (Conductive Member)
20*a* One End
20*b* Other End
40 Housing (Insulator)
41 Bottom Housing
42 Top Housing
50 Shell
52 Coupling Arm
56 Rear Shell Portion
58, 58A, 58B, 58C, 58D Interlocking Portion
70, 70A, 70B, 70C, 70D, 70E Elastic Sealing Material
80 Outer Mold
82 Recess
90 Gasket
102 Main Connector Part
200 Electronic Device
210 Device Casing
220, 401 Opening
411, 421 Through Hole
412 Reinforcing Board
413, 423 Gutter Portion
561 Leg
563 Main Plate Portion
565 Back Shield Portion
581, 583, 584, 585, 58*a* Protrusion
582 Recess
701, 702, 703, 704 Outer Surface
705 Cutout

The invention claimed is:

1. A connector incorporated into a case of an electronic device and including a plurality of contacts each of which includes one end to be connected to a mating contact of an external connector, the connector comprising:

a housing main body inside which a portion between the one end and an other end of each of the plurality of contacts is disposed, the housing main body being configured to support the plurality of contacts such that the plurality of contacts are disposed side by side;

an outer mold provided on a periphery of the plurality of contacts on a side of the other end with respect to the housing main body;

a gasket, provided to an outer periphery of the connector to be attached to the electronic device in an airtight manner, configured to prevent water ingress from an outside into an inside of the connector; and an elastic sealing material provided on a position between the plurality of contacts and the outer mold in such a manner as to come into tight contact with peripheries of the plurality of contacts, the elastic sealing material serving as a seal against water ingress between the housing main body and the plurality of contacts from a side of the one end to the side of the other end, wherein:

the elastic sealing material is configured to be in tight contact with the outer mold and be surrounded in such a manner as to be encapsulated by the outer mold.

2. The connector according to claim 1, further comprising:

a shell which is cylindrical and inside which the housing main body is disposed, wherein:

the shell is provided with a back shield coupled with the shell via a coupling arm, the back shield covers the other end of each of the plurality of contacts from the side of the other end, the coupling arm is disposed along an extending direction of each of the plurality of contacts, and the elastic sealing material is provided such that an outer periphery of a portion of the coupling arm is in tight contact with the elastic sealing material.

3. The connector according to claim 1, wherein:

the outer mold includes an annular recess formed in an outer surface of the outer mold in the circumferential direction, and the gasket is attached to the outside of the annular recess.

4. The connector according to claim 1, wherein:

the elastic sealing material is formed from polyester-based thermoplastic elastomer.

5. The connector according to claim 1, wherein:

the elastic sealing material includes irregularities on a surface of the elastic sealing material.

* * * * *